US008896520B2

(12) United States Patent
Murayama et al.

(10) Patent No.: US 8,896,520 B2
(45) Date of Patent: Nov. 25, 2014

(54) ELECTROPHORETIC DISPLAY APPARATUS AND ELECTRONICS DEVICE

(75) Inventors: Tetsuro Murayama, Shiojiri (JP); Yukimasa Ishida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 636 days.

(21) Appl. No.: 13/155,046

(22) Filed: Jun. 7, 2011

(65) Prior Publication Data

US 2011/0304654 A1 Dec. 15, 2011

(30) Foreign Application Priority Data

Jun. 9, 2010 (JP) ..... 2010-131896

(51) Int. Cl.
*G09G 3/34* (2006.01)

(52) U.S. Cl.
CPC ..... *G09G 3/3446* (2013.01); *G09G 2300/0814* (2013.01); *G09G 2300/0426* (2013.01)
USPC ..... 345/107; 345/105; 345/108

(58) Field of Classification Search
CPC ... G09G 3/344; G09G 2310/068; G02F 1/167
USPC ..... 345/107; 359/296
See application file for complete search history.

(56) References Cited

U.S. PATENT DOCUMENTS

| | | | | |
|---|---|---|---|---|
| 2004/0150325 | A1 * | 8/2004 | Yamakita et al. | 313/498 |
| 2007/0188848 | A1 | 8/2007 | Machida et al. | |
| 2009/0268274 | A1 | 10/2009 | Masuzawa et al. | |
| 2011/0286076 | A1 * | 11/2011 | Lin et al. | 359/296 |

FOREIGN PATENT DOCUMENTS

| | | |
|---|---|---|
| JP | 2007-212854 A | 8/2007 |
| JP | A-2009-9092 | 1/2009 |
| JP | A-2009-98382 | 5/2009 |

* cited by examiner

*Primary Examiner* — Alexander S Beck
*Assistant Examiner* — Nguyen H Truong
(74) *Attorney, Agent, or Firm* — Oliff PLC

(57) ABSTRACT

An electrophoretic display apparatus includes a first substrate and a second substrate; an electrophoretic layer that is allocated between the first substrate and the second substrate; and a first electrode and a second electrode that are each formed in an island shape, for each pixel, at the electrophoretic layer side of the first substrate, and are mutually independently driven. The first and second electrodes form a comb-teeth shaped electrode in a plan view, which include a plurality of branch portions and a trunk portion combining the plurality of branch portions, and each of first ones of the branch portions, which are located at respective edge portions of a pixel area, has a width smaller than a width of each of second ones of the branch portions, which are branch portions other than the first branch portions.

10 Claims, 13 Drawing Sheets

IN ADDITION, A PAIR OF STORAGE CAPACITORS ARE ALSO PROVIDED WITHIN EACH PIXEL.

BLACK COLOR DISPLAY

WHITE COLOR DISPLAY

RED COLOR DISPLAY

ELECTROPHORETIC DISPLAY APPARATUS AND ELECTRONICS DEVICE

BACKGROUND

1. Technical Field

The present invention relates to an electrophoretic display apparatus and an electronics device.

2. Related Art

With respect to electrophoretic display apparatuses each having a function of displaying color images, heretofore, an electrophoretic display element enveloping therein three kinds of particles, i.e., white color ones, black color ones and another color ones, has been proposed. In such an electrophoretic display element, individual particles are sorted into positively charged particles, negatively charged particles and non-charged particles. At the side of an active matrix substrate for driving the display elements, each pixel is provided with two pixel electrodes. Further, on an opposite substrate, a common electrode that is common to all pixels is provided.

Once both of the two pixel electrodes on the active matrix substrate and the common electrode are supplied with a positive electric potential and a negative electric potential, negatively charged particles and positively charged particles are attracted to the active matrix substrate side and the common electrode side, respectively. Therefore, users view a color tone created by the positively charged particles.

Further, once the two pixel electrodes on the active matrix substrate are supplied with a positive electric potential and a negative electric potential, respectively, and the common electrode is supplied with an intermediate electric potential therebetween (for example, a ground electric potential), both of the positively charged particles and the negatively charged particles are attracted to the active-matrix substrate side owing to electric fields arising from the two pixel electrodes. Therefore, users view a color tone created by the none-charged particles (refer to JP-A-2009-9092 and JP-A-2009-98382).

Here, in order to obtain the color tone created by the non-charged particles, it is necessary to cause electric fields to arise uniformly throughout the whole area of each pixel so that all of the positively charged particles and the negatively charged particles can be attracted to the active matrix substrate side. In order to realize this condition, a configuration resulting from combining and allocating comb-teeth shaped pixel electrodes is used in lots of cases.

However, supplying respective adjacent pixel electrodes with mutually different electric potentials results in occurrence of leakage current between the pixel electrodes via an electrophoretic layer. This leakage current flows between the two pixel electrodes, and thus, an amount of leakage current becomes larger in proportion to the length of a boundary between the two pixel electrodes. Therefore, in the case of the comb-teeth shaped pixel electrodes, a large amount of leakage current flows. Furthermore, the occurrence of leakage current leads to an increase of power consumption of an electrophoretic display panel.

Moreover, owing to such leakage current, there is a possibility of causing an electrochemical reaction between the electrophoretic layer and each of the pixel electrodes. Namely, there is a possibility of detracting reliability of the pixel electrodes. That is, there is a high possibility of occurrence of ionic migrations and/or corrode. If a precious metal, such as gold or platinum, is used as a material of the pixel electrodes, the reliability is enhanced; however, the use of such a material leads to an increase of cost and a growth of complexity of manufacturing processes thereof. Therefore, it has been difficult to enhance the reliability, and concurrently therewith, suppress increase of the cost. Consequently, in order to reduce an amount of such leakage current, a method for reducing the length of a boundary between the mutually adjacent pixel electrodes by enlarging a width of each of branch portions of the comb-teeth shaped pixel electrodes and/or enlarging each distance between the mutually adjacent two pixel electrodes can be conceived.

However, depending on the width of each of the pixel electrodes and the distance between the mutually adjacent two pixel electrodes, a problem in that there occur areas that are not subjected to any electric fields occurs, and as a result, particles existing at the common pixel side cannot be attracted. This phenomenon remarkably occurs in edge portions of each pixel area. Namely, particles distributed immediately above any one of branch portions located at the middle side of each pixel area are attracted by actions of electric fields arising from either of branch portions of a different pixel electrode, which are located at respective both sides of the branch portion located at the middle side thereof; however, each of branch portions located at respective peripheral edge portions of the pixel area is subjected to actions of electric fields arising from only one branch portion of a different pixel electrode, which is located at one side of and adjacent to the branch portion located at the peripheral edge portion thereof. Therefore, as a result, such a phenomenon causes a problem in that particles located at peripheral edge portions of the pixel area cannot be attracted.

Unintentional particles remaining at the common electrode side results in occurrence of unevenness of display.

SUMMARY

An advantage of some aspects of the invention is to provide an electrophoretic display apparatus and an electronics device that enable reduction of leakage current occurring between each pair of pixel electrodes by reducing the length of a boundary between each pair of pixel electrodes, and further, provision of a favorable display even on edge portions of each pixel area.

An electrophoretic display apparatus according to an aspect of the invention includes a first substrate and a second substrate, an electrophoretic layer that is allocated between the first substrate and the second substrate, and includes particles having first color, particles having second color and a dispersion medium, a first electrode and a second electrode that are each formed in an island shape, for each pixel, at the electrophoretic layer side of the first substrate, and are mutually independently driven, and a common electrode that is formed at the electrophoretic layer side of the second substrate, and is larger than a total area of the first electrode and the second electrode. Further, each of the first electrode and the second electrode forms a comb-teeth shaped electrode in a plan view, which includes a plurality of branch portions and a trunk portion combining the plurality of branch portions, and among two groups of the plurality of branch portions of the respective first and second electrodes, the two groups of the plurality of branch portions being aligned in one direction, each of first ones of the branch portions, which are located at respective edge portions of a pixel area, has a width smaller than a width of each of second ones of the branch portions, which are branch portions other than the first branch portions.

According to this aspect of the invention, it is possible to, by reducing the length of a boundary between a pair of pixel electrodes within one pixel, reduce leakage current occurring between each pair of pixel electrodes, and further, obtain a favorable display even on edge portions of a pixel circuit.

A width of the first branch portion may be smaller than or equal to ⅔ the width of the second branch portion.

According to this aspect of the invention, it is possible to, by allowing electric fields to act on all particles, perform control of movements of the particles, prevent unintentional particles from remaining at the second electrode side, and thus, suppress occurrence of unevenness of display.

A width of the first branch portion may be smaller than or equal to ½ the width of the second branch portion.

According to this aspect of the invention, it is possible to, by allowing electric fields to act on all particles, perform control of movements of the particles, prevent unintentional particles from remaining at the second electrode side, and thus, suppress occurrence of unevenness of display.

A width of the first branch portion may be larger than or equal to ⅓ the width of the second branch portion.

According to this aspect of the invention, if the length of a boundary between each pair of pixel electrodes is a length that does not cause any leakage current to occur between any two adjacent branch portions, a width of the first branch portion may be set to a width larger than or equal to ⅓ the width of the second branch portion. In this way, it is possible to, by allowing electric fields to act on all particles, perform control of movements of all the particles, prevent unintentional particles from remaining at the second electrode side, and thus, suppress occurrence of unevenness of display.

A width-direction inner edge portion of the first branch portion may be aligned with a pitch that corresponds to a pitch with which a plurality of the second branch portions are aligned.

According to this aspect of the invention, a width-direction inner edge portion of the first branch portion is aligned with a pitch that corresponds to a pitch with which a plurality of branch portions other than the first branch portion are aligned. Therefore, even an area immediately above the first branch portion is favorably subjected to electric fields arising from the second branch portion of a different electrode, which is located at one width-direction side of and adjacent to the first branch portion.

An electronics device according to another aspect of the invention includes the above-described electrophoretic display apparatus.

According to another aspect of the invention, it is possible to obtain an electronics device including a display unit that can be driven with low power consumption, and further, is a high-quality one with no unevenness of display.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the presentation will be described with reference to drawings. In addition, in each drawing for the following description, in order that individual members can be provided with corresponding sizes that allow themselves to be recognizable, corresponding scales of the individual members are appropriately changed.

Figure 1:
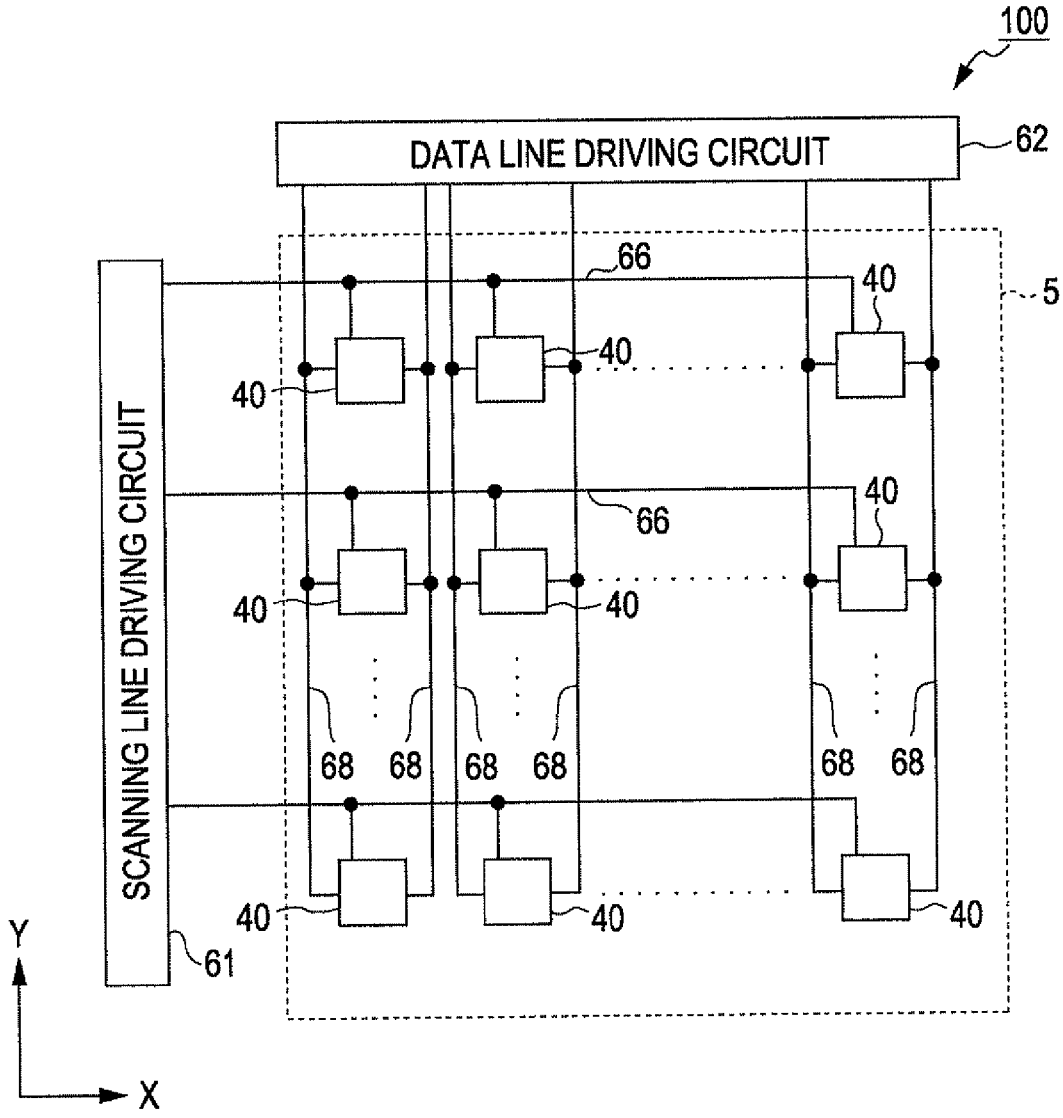
FIG. 1 is an equivalent circuit diagram illustrating the whole configuration of an electrophoretic display apparatus according to an embodiment of the invention.

FIG. 1 is an equivalent circuit diagram illustrating the whole configuration of an electrophoretic display apparatus according to an embodiment of the invention.

As shown in FIG. 1, in a display unit 5 of an electrophoretic display apparatus 100, a plurality of pixels 40 are aligned in a matrix. In peripheral portions of the display unit 5, a scanning line driving circuit 61 and a data line driving circuit 62 are allocated. The scanning line driving circuit 61 and the data line driving circuit 62 each are connected to a controller (not illustrated). The controller performs comprehensive control of the scanning line driving circuit 61 and the data line driving circuit 62 on the basis of image data and synchronization signals supplied from upper apparatuses.

In the display unit 5, a plurality of scanning lines 66 extending from the scanning line driving circuit 61 and a plurality of data lines 68 extending from the data line driving circuit 62 are formed, and pixels 40 are provided so as to correspond to respective positions of intersections thereof. To each of the pixels 40, two different data lines, that is, a data line 68A (a first data line) and a data line 68B (a second data line) are connected.

The scanning line driving circuit 61 is connected to the pixels 40 via the plurality of corresponding scanning lines 66.

Further, under control of the controller, the scanning line driving circuit 61 sequentially selects each of the scanning lines 66, and via the selected scanning line 66, supplies selection transistors TR1 and TR2 (refer to FIG. 2) included in the corresponding pixel 40 with a selection signal for specifying a turning-on timing thereof. The data line driving circuit 62 is connected to the pixels 40 via the plurality of corresponding data lines 68. Further, under control of the controller, the data line driving circuit 62 supplies each of the pixels 40 with an image signal for specifying image data corresponding to the pixel 40.

Figure 2:
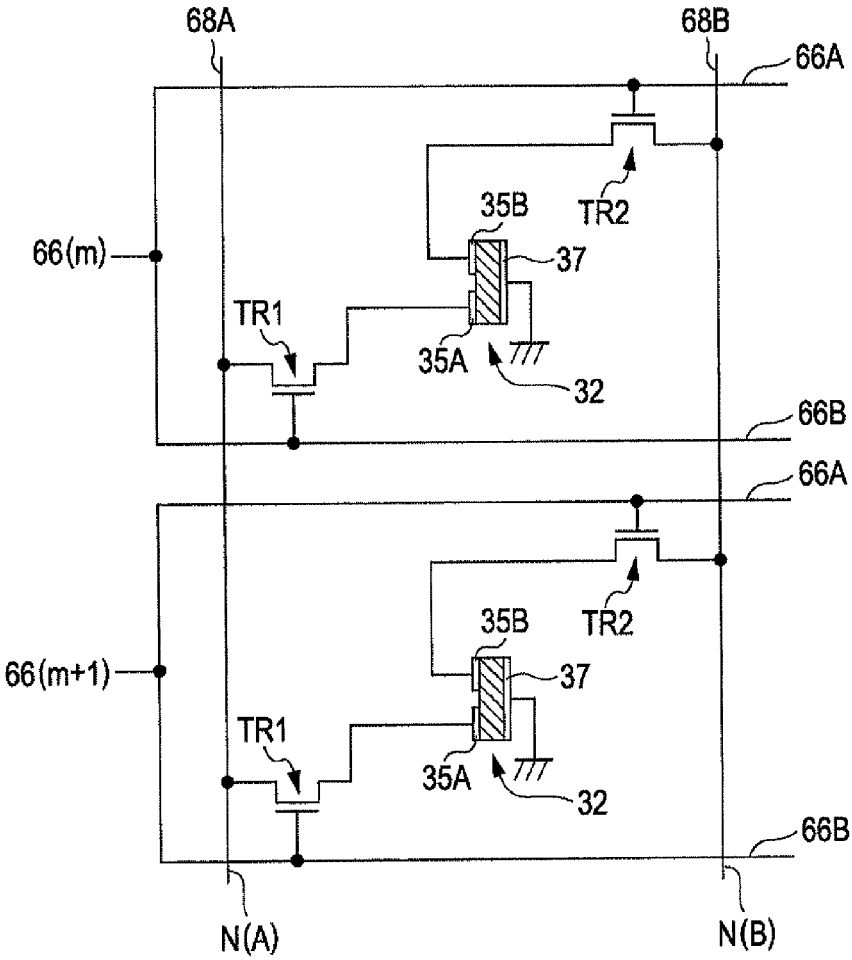
FIG. 2 is an equivalent circuit diagram illustrating a configuration of a pixel of an electrophoretic display apparatus according to an embodiment of the invention.

FIG. 2 is an equivalent circuit illustrating a configuration of a pixel of an electrophoretic display apparatus according to an embodiment of the invention.

As shown in FIG. 2, in the electrophoretic display apparatus 100 according to this embodiment, the two selection transistors TR1 and TR2 and two pixel electrodes 35A and 35B are provided within one of the pixels 40. A pixel circuit for each of the pixels 40 is configured to include an electrophoretic layer 32 as an electro-optical material; the selection transistors TR1 and TR2 each performing a switching operation for supplying a voltage to the electrophoretic layer 32; the pixel electrodes 35A and 35B connected to the respective selection transistors TR1 and TR2; and a common electrode 37. By allowing the two selection transistors TR1 and TR2 to independently perform control of voltages that are applied to the pixel electrodes 35A and 35B, respectively, it is possible to display images with no crosstalk.

Specifically, the selection transistors TR1 and TR2 have respective gates, which are connected to the scanning line 66, respective sources, which are connected to the data lines 68A and 68B, and respective drains, which are connected to the electrophoretic layer 32. Specifically, for a pixel 40A, which is selected from pixels 40A and 40B that are located adjacent to each other in a row direction along which the data lines 68A and 68B extend, an m-th line of the scanning lines 66 is connected to the respective gates of the selection transistors TR1 and TR2. The scanning line 66 branches to the two scanning lines 66A and 66B within the pixel 40, but outside the display area, the scanning lines 66A and 66B are integrated into one scanning line, and thereto, the same voltage is supplied.

Further, an N(A)-th line of the data lines, i.e., the data line 68A, is connected to the source of the selection transistor TR1, and the pixel electrode 35A (the electrophoretic layer 32) is connected to the drain of the selection transistor TR1. Further, an N(B)-th line of the data lines, i.e., the data line 68B, is connected to the source of the selection transistor TR2, and the pixel electrode 35B (the electrophoretic layer 32) is connected to the drain of the selection transistor TR2.

Figure 3:
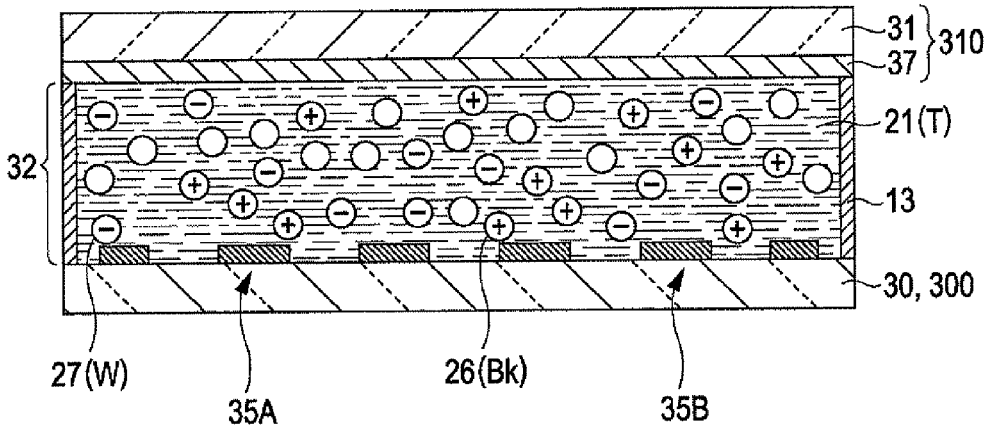
FIG. 3 is a cross-sectional view illustrating an outline of a configuration of a pixel of an electrophoretic display apparatus according to an embodiment of the invention.

FIG. 3 is a cross-sectional view illustrating an outline of a configuration of a pixel of an electrophoretic display apparatus according to this embodiment.

In addition, here, attention is focused on one pixel, and a no-voltage applied condition is shown.

As shown in FIG. 3, the electrophoretic display apparatus 100 is configured to include the electrophoretic layer 32 having a three-particle system between an element substrate 300 (a first substrate) and an opposite substrate 310 (a second substrate). The electrophoretic layer 32 is configured to retain black-color positively charged particles 26 (Bk), white-color negatively charged particles 27 (W) and red-color non-charged particles 28 (R) within a transparent dispersion medium 21 (T). The charged particles (the positively charged particles 26 (Bk) and the negatively charged particles 27 (W)) behave as electrophoretic particles within the electrophoretic layer 32. It is assumed that viewers view display images from the second substrate 31 side.

The element substrate 300 is configured to include a first substrate 30 made of glass, plastic or the like, and may not be transparent because it is allocated at the side opposite an image display surface. On the first substrate 30, a circuit element layer 34 (refer to FIG. 5) having therein the scanning lines 66, the data lines 68, the selection transistors TR1 and TR2 and the like is formed.

Further, at the electrophoretic layer 32 side of the element substrate 300, that is, on the circuit element layer 34 (refer to FIG. 5), a pair of the pixel electrode 35A (the first electrode) and the pixel electrode 35B (the second electrode), each forming a comb-teeth shape when viewed in a plan view, are formed for each of the pixels 40. The pixel electrodes 35A and 35B can be mutually independently driven.

In contrast, the opposite substrate 310 is configured to include a second substrate 31 made of glass, plastic or the like. This second substrate 31 is configured by a transparent substrate because it is allocated at the image display side. At the electrophoretic layer 32 side of the second substrate 31, the common electrode 37 having a planar shape is formed so as to be opposite a plurality of pairs of the image electrodes 35A and 35B, and on the common electrode 37, the electrophoretic layer 32 is formed. The common electrode 37 is a transparent electrode formed of MgAg, ITO, IZO (indium zinc oxide) and the like, and has an area larger than the total area of the pixel electrodes 35A and 35B, which are located at the element substrate 300 side.

The opposite substrate 310 configured in such a way is allocated above the opposite element substrate 300 via partition walls 13 for partitioning individual pixel areas.

Figure 4:
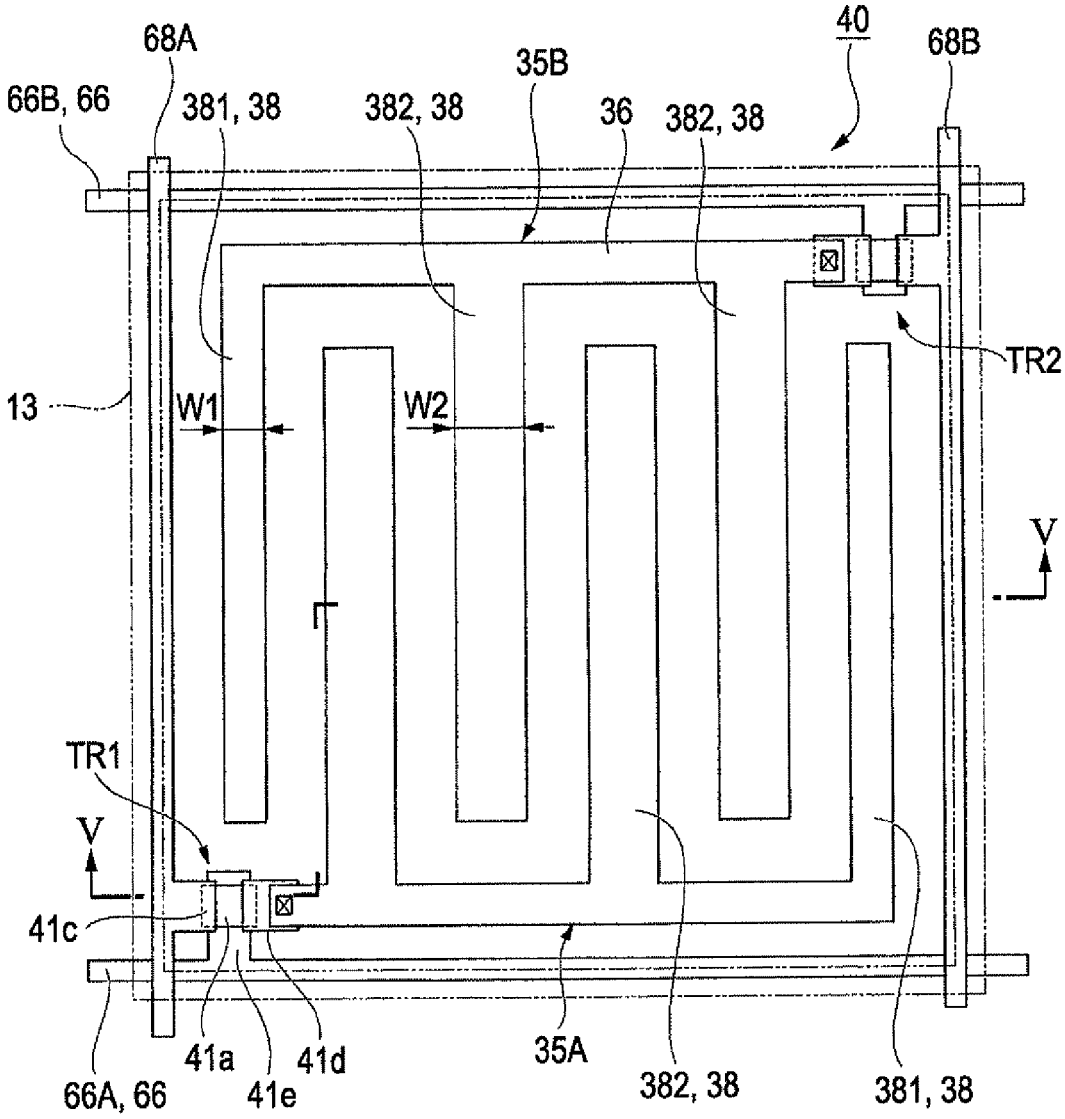
FIG. 4 is a plan view illustrating an outline of a configuration of a pixel of an electrophoretic display apparatus according to an embodiment of the invention.

FIG. 4 is a plan view illustrating an outline of a configuration of a pixel allocated on an element substrate.

As shown in FIG. 4, the pixel electrodes 35A and 35B are configured to have trunk portions 36, which extend along the scanning lines 66A and 66B, and two groups of a plurality of branch portions 38, which are combined with the trunk portions 36, respectively. Further, the two groups of branch portions 38 are allocated so as to mutually gear. Namely, the above-described condition is such that any two successive ones of the branch portions 38 of the pixel electrode 35A exist at respective both sides of one of the branch portions 38 of the pixel electrode 35B. By causing each of the pixel electrodes 35A and 35B to form a comb-teeth shape, it is made easier for particles to move between the pixel electrodes 35A and 35B.

Further, among two groups of a plurality of branch portions 38 of the respective pixel electrodes 35A and 35B according to this embodiment, the two groups of a plurality of branch portions 38 being aligned in one direction at even intervals, each of first branch portions 381 (first branch portions), which are located at the respective peripheral edge portions of a pixel area (at the most outer peripheral sides of the pixel 40), has a width W1 smaller than a width W2 of each of second branch portions 382 (second branch portions), which are branch portions other than the first branch portions 381.

Specifically, the width W1 of the first branch portion 381 is made ⅔ of the width W2 of the second branch portion 382.

Further, the pixel electrodes 35A and 35B are allocated with a predetermined distance therebetween so as not to be overlapped by each other within the same pixel area. Furthermore, pitches (allocation distances) between any two adjacent branch portions selected from among the two groups of the branch portions 38 of the respective pixel electrodes 35A and 35B are made equal to one another.

Further, the partition walls 13, which form a lattice shape when viewed from a plan view, are allocated so as to partition individual pixel areas, and form a frame shape so as to surround the pixel electrodes 35A and 35B. The partition wall 13 is made of a material the same as that of a liquid crystal apparatus, and here, as the material of the partition wall 13, a photosensitive acrylic material is used. Alternatively, an inorganic material or an organic material may be used, and further, a thermosetting epoxy resin may be also used.

Figure 5:
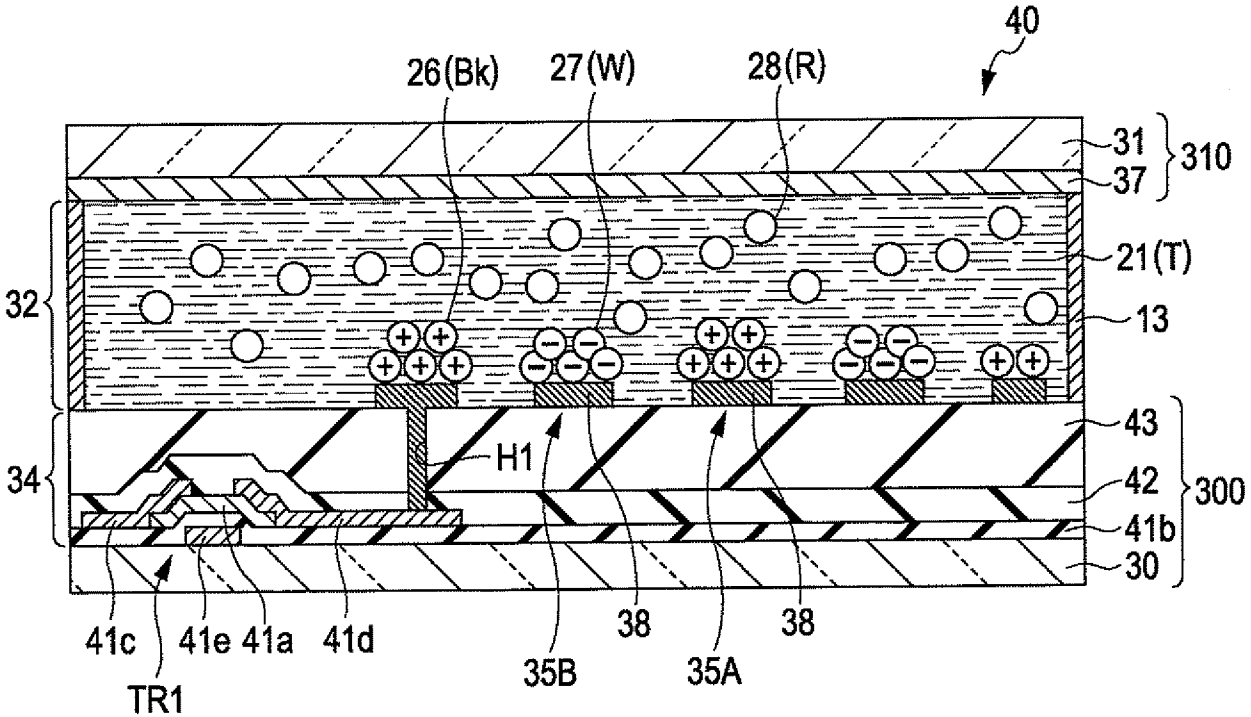
FIG. 5 is a partial sectional-view illustrating an element substrate taken along the line V-V of FIG. 4.

FIG. 5 is a partial sectional-view illustrating an element substrate taken along the line V-V of FIG. 4.

The element substrate 300 is configured so that, specifically, as shown in FIG. 5, a gate insulating film 41*b* made of an oxide silicon film is formed on the whole surface of the first substrate 30 so as to cover a gate electrode 41*e*, which is formed on the surface of the first substrate 30 made of a glass substrate of width of 0.6 mm, and is made of an aluminum (Al) material of width of 300 nm, and a semiconductor layer 41*a* made of a-IGZO (an oxide of In, Ga and Zn) is formed immediately above the gate electrode 41*e*.

On this gate insulating film 41*b*, a source electrode 41*c* (the data line 68) and a drain electrode 41*d*, each being made of an aluminum (Al) material of width of 300 nm, are provided so as to be partially overlapped by each of the gate electrode 41*e* and the semiconductor layer 41*a*. The source electrode 41*c* and the drain electrode 41*d* each are formed so as to partially mount the semiconductor layer 41*a*.

Here, as the selection transistor TR1 (TR2), a commonly-used TFT, such as an a-SiTFT, a poly-SiTFT, an organic TFT, or an oxide TFT, can be used. Regarding a structure thereof, either of a top-gate structure or a bottom-gate structure can be used.

On the gate insulating film 41*b*, an interlayer insulating film 42, which is made of an oxide silicon film of width of 300 nm, and an interlayer insulating film 43, which is made of a photosensitive acrylic material of width of 1 μm, are formed so as to cover the selection transistor TR1 (TR2: not illustrated). This interlayer insulating film 43 functions as a planarization film. In addition, if the function as a planarization film can be added to the interlayer insulating film 42, the interlayer insulating film 43 is not necessary, but can be omitted. On the interlayer insulating film 43, the pixel electrodes 35A and 35B, each being made of ITO of width of 50 nm, are provided, and further, are connected to the drains of the selection transistors TR1 and TR2 (not illustrated) via contact holes H1 and H2 (not illustrated), respectively. The contact holes H1 and H2 each are formed so as to penetrate the interlayer insulating films 42 and 43. Consequently, the element substrate 300 is configured by individual elements starting from the first substrate 30 up to the pixel electrodes 35A and the 35B.

Figure 6A:
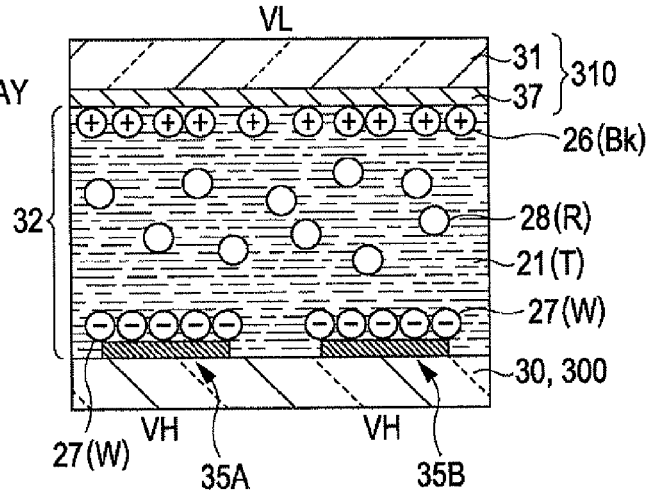
FIGS. 6A, 6B and 6C are diagrams each illustrating a principle of operations performed by an electrophoretic apparatus using a three-particle method, according to an embodiment of the invention.
Figure 6B:
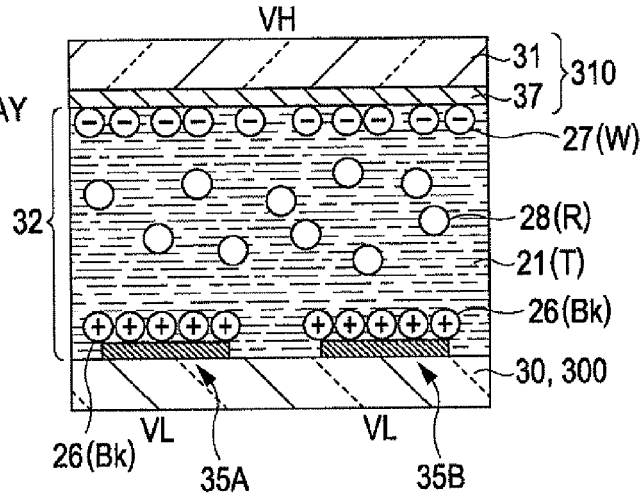
Figure 6C:
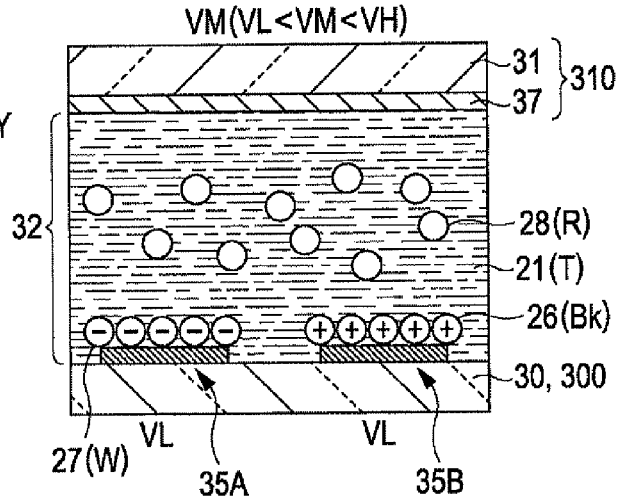

FIGS. 6A, 6B and 6C are diagrams each illustrating a principle of operations performed by an electrophoretic display apparatus using a three-particle method.

Further, it is assumed that either of a positive voltage applied to the pixel electrode 35A or a positive voltage applied to the pixel electrode 35B, whichever is maximum in absolute value, is denoted by a voltage VH (hereinafter, which will be also denoted by a positive maximum value), and either of a negative voltage applied to the pixel electrode 35A or a negative voltage applied to the pixel electrode 35B, whichever is maximum in absolute value, is denoted by a voltage VL (hereinafter, which will be also denoted by a negative maximum value).

In addition, "an operation of applying a certain voltage to an electrode" has the same meaning as "an operation of supplying the electrode with an electric potential so that a voltage between the electric potential of the electrode and the ground electric potential can be equal to the certain voltage".

FIG. 6A is a diagram illustrating a distribution condition of particles in the case of black color display.

When black color display is desired, the positive voltage VH is applied to the pixel electrodes 35A and 35B, and the negative voltage VL is applied to the common electrode 37. As a result, electric fields due to an electric potential difference (a voltage) between an electric potential corresponding to the voltage VH and the ground electric potential of the common electrode 37 cause a condition in which all of the positively charged particles 26 (Bk) are moved to the common electrode 37 side, and a plurality of the negatively charged particles 27 (W) are absorbed onto the pixel electrodes 35A and 35B. Further, externally incoming light rays are scattered by the positively charged particles 26 (Bk) distributed on the common electrode 37, and the light rays, the color of which has varied to black color, are outputted from the common electrode 37 side.

FIG. 6B is a diagram illustrating a distribution condition of particles in the case of white color display.

When the black color display is switched to white color display, subsequent to the condition shown in FIG. 6A, an operation of changing applied voltages is further performed. In order to perform the switching from the black color display to the white color display, the negative voltage VL is applied to the pixel electrodes 35A and 35B, and the positive voltage VH is applied to the common electrode 37. As a result, such an operation of changing applied voltages causes a condition in which all the negatively charged particles 27 (W) existing on the pixel electrodes 35A and 35B are moved to the common electrode 37 side, so that, this time, the positively charged particles 26 (Bk) are absorbed onto the pixel electrodes 35A and 35B. Further, externally incoming light rays are scattered by the negatively charged particles 27 (W) distributed on the common electrode 37, and the light rays, the color of which has varied to white color, are outputted from the common electrode 37 side.

FIG. 6C is a diagram illustrating a distribution condition of particles in the case of red color display.

When the white color display is switched to red color display, subsequent to the condition shown in FIG. 6B, an operation of changing applied voltages is further performed. In order to perform the switching from the white color display to the red color display, the positive voltage VH is applied to the pixel electrode 35A, the negative voltage VL is applied to the pixel electrode 35B, and a voltage VM, which is an intermediate voltage between the positive voltage VH applied to the pixel electrode 35A and the negative voltage VL applied to the pixel electrode 35B, that is, VL<VM<VH, is applied to the common electrode 37. As a result, such a further operation of changing applied voltages causes a condition in which the negatively charged particles 27 (W) are absorbed onto the pixel electrode 35A, and the positively charged particles 26 (Bk) are absorbed onto the pixel electrode 35B. Further, externally incoming light rays are scattered by the non-charged particles 28 (R) floating within the dispersion medium 21 (T), and the light rays, the color of which has varied to red color, are outputted from the common electrode side 37.

In addition, it is possible to perform control of an amount of movement and a range of distribution of the positively charged particles 26 (Bk) or the negatively charged particles 27 (W) towards the common electrode 37 side by using design factors, such as a distance between the pixel electrodes 35A and 35B, sizes of the pixel electrodes 35A and 35B, and applied voltage values. Further, in the above-described embodiment, an amount of movement and a range of distribution of the positively charged particles 26 (Bk) or the negatively charged particles 27 (W) towards the common electrode side are controlled by levels of voltages applied to the respective pixel electrodes 35A and 35B, but can be also controlled by lengths of duration times for applying voltages to the respective pixel electrodes 35A and 35B.

In addition, control of brightness is performed by using visible areas of particles when the electrophoretic layer 32 is seen from the outside of the common electrode 37.

Here, for the white color display using the particles 27 (W), incoming light rays are necessary to be scattered by the particles a plurality of times, and thus, a three dimensional distribution of the particles in a depth direction within the electrophoretic layer 32 is also required. Therefore, in this case, the above-described "visible areas" denote actually visible effective areas taking into account two-dimensional and three-dimensional distributions of the particles.

As described above, it is possible to perform control of brightness for each pixel by performing control of an amount of movement and a range of distribution of the positively charged particles 26 (Bk) or the negatively charged particles 27 (W).

Figure 9:
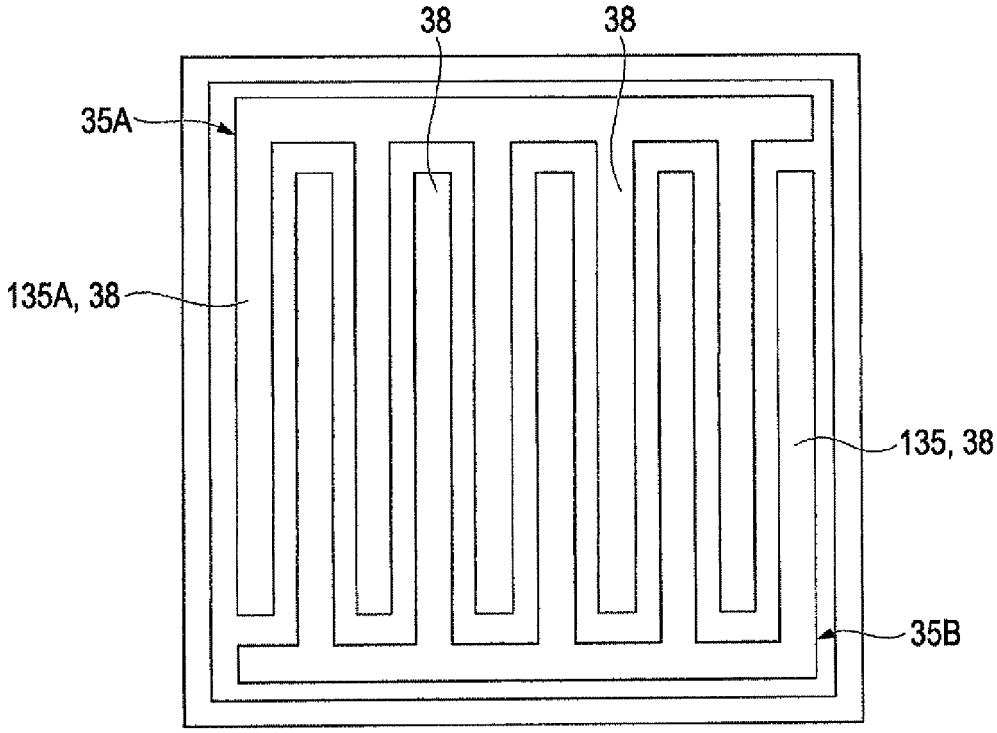
FIG. 9 is a plan view illustrating an example of commonly-used comb-teeth shaped pixel electrodes.
Figure 10:
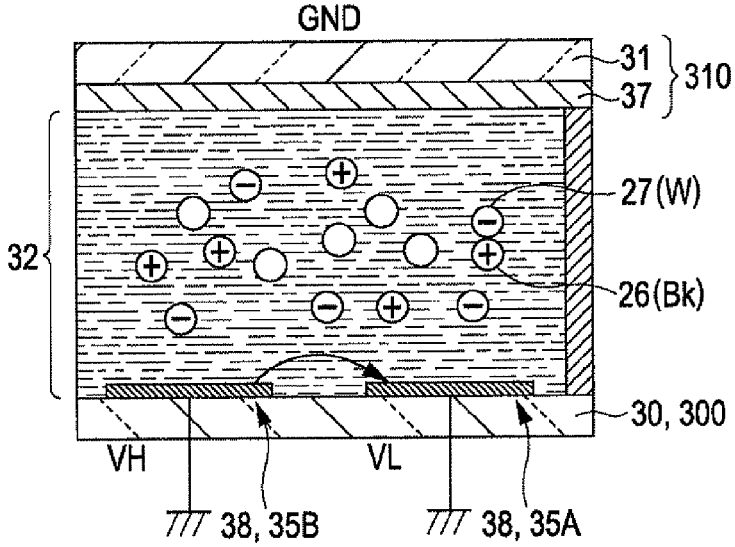
FIG. 10 is a conceptual diagram illustrating leakage current flowing between a pair of pixel electrodes.

By the way, to date, in order to cause longitudinally spreading electric fields to uniformly occur within each pixel, a pair of the pixel electrodes 35A and 35B, each forming a comb-teeth shape when viewed in a plan view, have been combined. In general, in a configuration of the pixel electrodes 35A and 35B, each forming a comb-teeth shape when viewed in a plan view, each of the plurality of the branch portions 38 is formed so as to have an even thickness, such as shown in FIG. 9. In such a case, when different electric potentials are applied to the respective adjacent pixel electrodes 35A and 35B, as a result, leakage current occurs between the pixel electrodes 35A and 35B (between each pair of the adjacent branch portions 38 of the respective pixel electrodes 35A and 35B) (refer to FIG. 10). This leakage current flows between the two pixel electrodes, and thus, an amount of leakage current becomes larger in proportion to the length of a boundary between the two pixel electrodes. Therefore, in the case of the pixel electrodes 35A and 35B each forming a comb-teeth shape, a large amount of leakage current flows.

Furthermore, the occurrence of leakage current leads to an increase of power consumption of a panel. Moreover, owing to such leakage current, there is a possibility of causing an electrochemical reaction between the electrophoretic layer 32 and each of the pixel electrodes 35A and 35B. Namely, there is a possibility of occurrence of ionic migrations and corrode, and thereby, detracting reliability of the pixel electrodes 35A and 35B. If a precious metal, such as gold or platinum, is used as a material of the pixel electrodes 35A and 35B, the reliability is enhanced; however, the use of such a material leads to an increase of cost and a growth of complexity of manufacturing processes thereof. Therefore, it has been difficult to enhance the reliability, and concurrently therewith, suppress increase of the cost.

Figure 11:
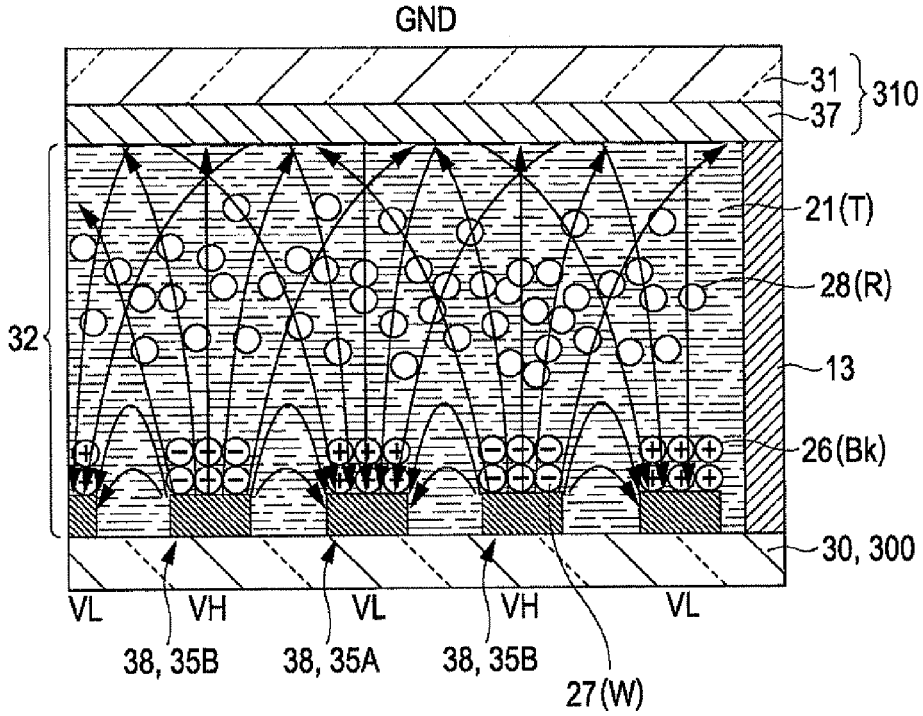
FIG. 11 is a conceptual diagram illustrating electric lines of force in the case of commonly-used comb-teeth shaped pixel electrodes.

When a pair of the pixel electrodes 35A and 35B each forming a comb-teeth shape are combined, such as shown in FIG. 9, there exist areas, such as shown in FIG. 11, in each of which two groups of longitudinally spreading electric fields arising from the respective two groups of the branch portions 38 of the pixel electrodes 35A and 35B are overlapped by each other (above the respective two groups of the branch portions 38, which are supplied with mutually opposite electric potentials). In order to move the electrophoretic particles 26 (Bk) and 27 (W) being kept within the electrophoretic layer 32 and being distributed at the common electrode 37 side to the pixel electrodes 35A and 35B side, it is necessary to merely cause either of the two groups of the electric fields arising from the respective pixel electrodes 35A and 35B to act thereon.

For example, on particles, existing above the branch portion 38 of the pixel electrode 35A and being distributed at the common electrode 37 side, it is necessary to merely cause electric fields arising from either of the two branch portions 38 of the pixel electrode 35B, which are located at respective both sides of the branch portion 38 of the pixel electrode 35A to act.

Figure 12:
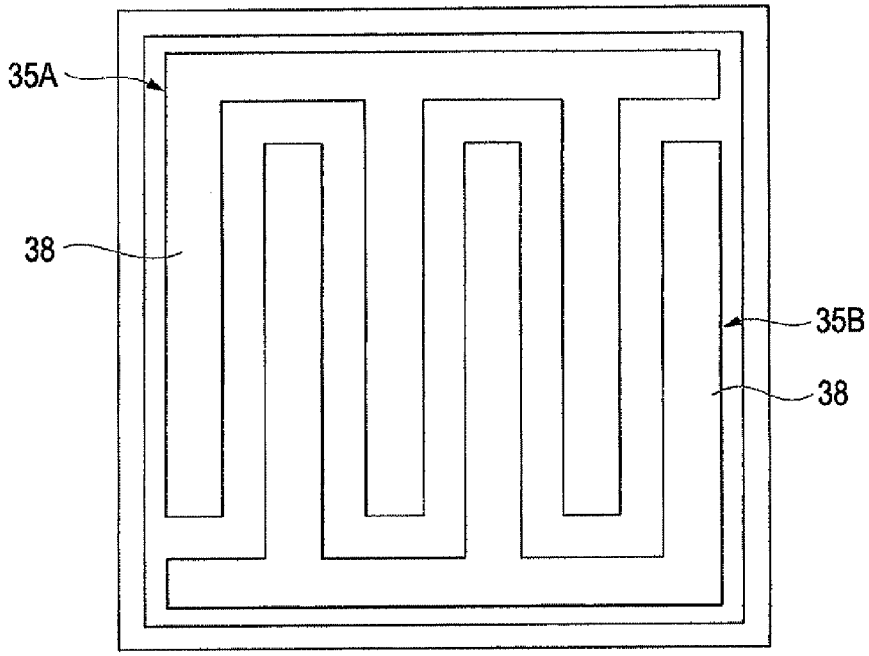
FIG. 12 is a plan view illustrating an example in which a width of each of electrodes is made large.
Figure 13:
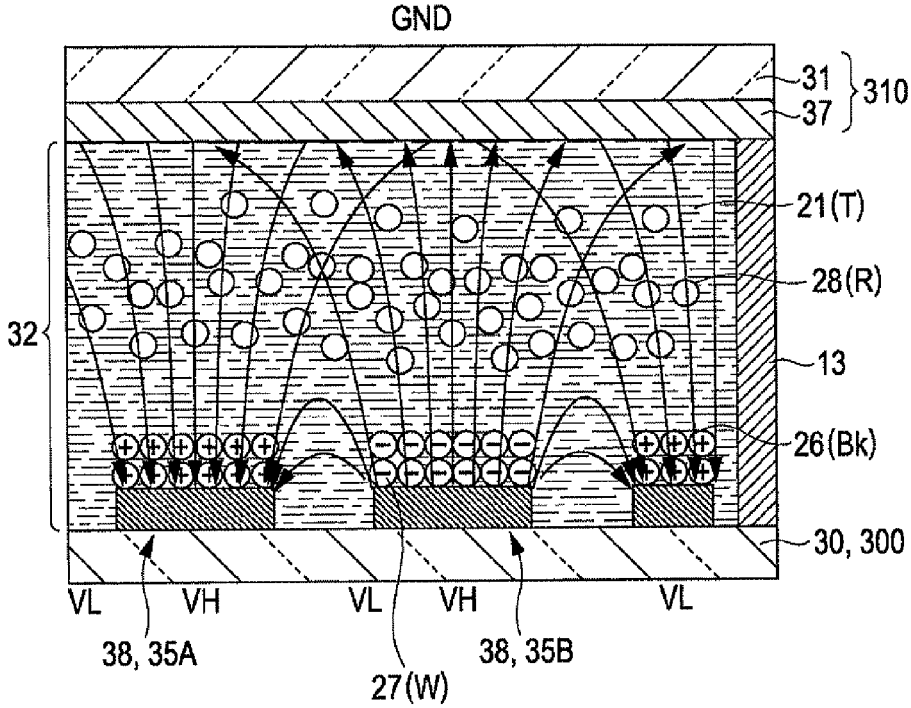
FIG. 13 is a cross-sectional view illustrating an example in which a width of each of electrodes is made large.
Figure 14:
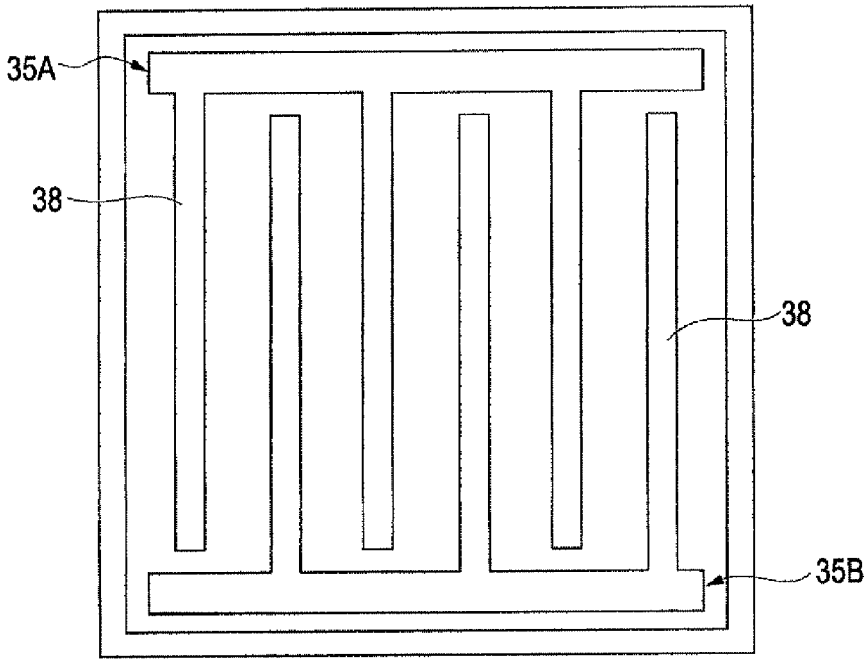
FIG. 14 is a plan view illustrating an example in which a distance between electrodes is made large.
Figure 15:
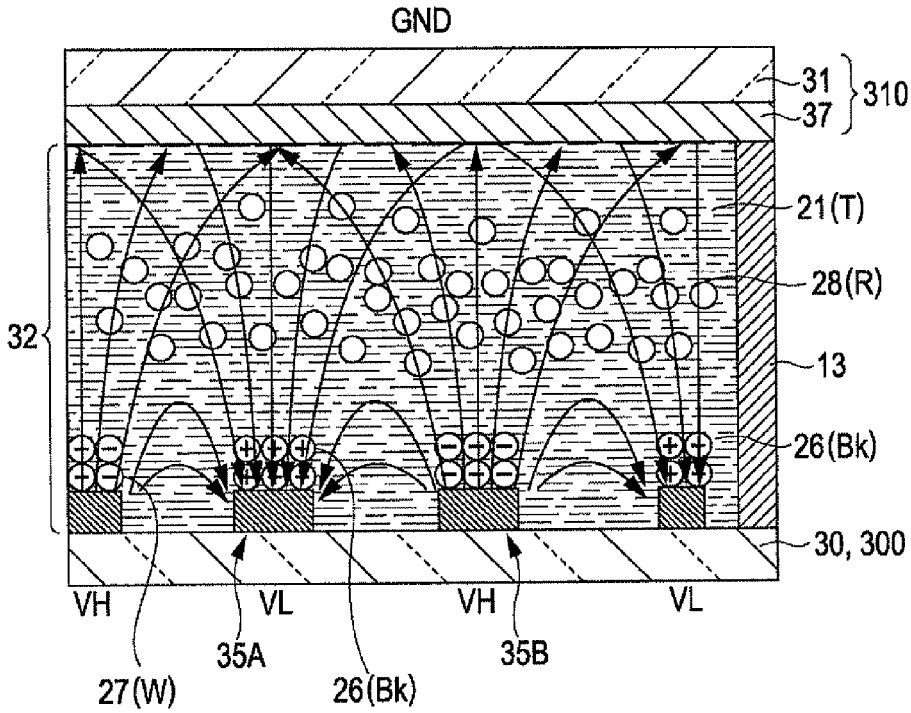
FIG. 15 is a cross-sectional view illustrating an example in which a distance between electrodes is made large.

As described above, in order to move the electrophoretic particles 26 (Bk) and 27 (W) being kept within the electrophoretic layer 32 to the pixel electrodes 35A and 35B side, it is necessary to merely cause either of the two groups of the electric fields arising from the respective pixel electrodes 35A and 35B act thereon. Therefore, by taking a measure of reducing the length of a boundary between the pixel electrodes 35A and 35B, it is possible to suppress such occurrence of leakage current as described above, and thereby, reduce power consumption. Further, the measure of reducing the length of a boundary between the pixel electrodes 35A and 35B results from enlarging a width of each of the branch portions 38 and 38 of the respective pixel electrodes 35A and 35B, such as shown in FIGS. 12 and 13, and/or enlarging a distance between each pair of the pixel electrodes 35A and 35B (a distance between the branch portions 38 and 38 of the respective pixel electrodes 35A and 35B), such as shown in FIGS. 14 and 15, by decreasing the number of the branch portions 38 of the pixel electrode 35A, as well as the number of the branch portions 38 of the pixel electrode 35B.

Figure 16:
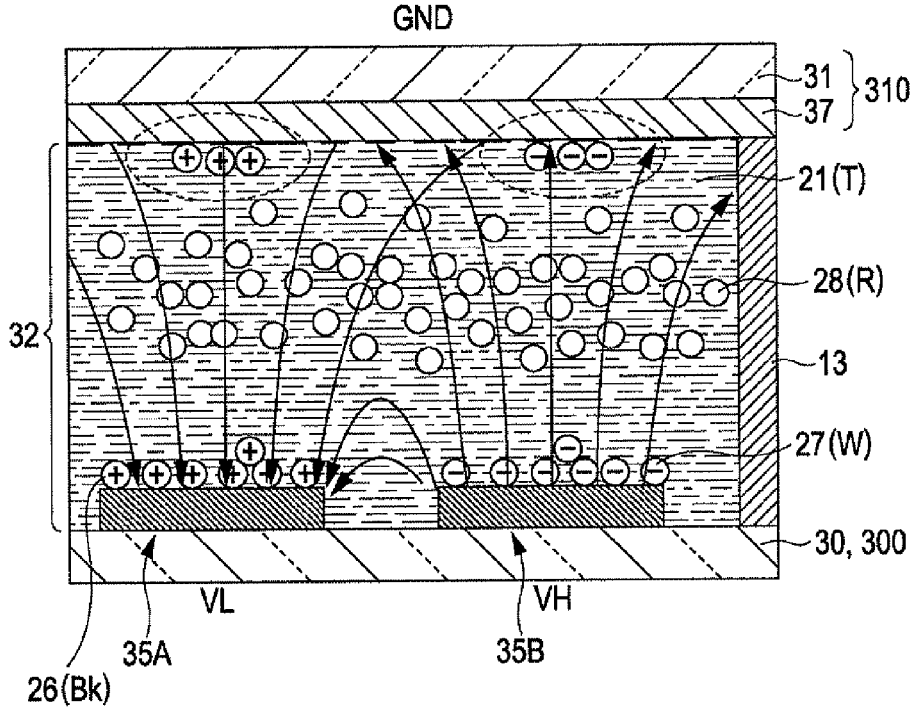
FIG. 16 is a conceptual diagram illustrating electric lines of force in the case where a width of each of electrodes is made large to an excessive degree.
Figure 17:
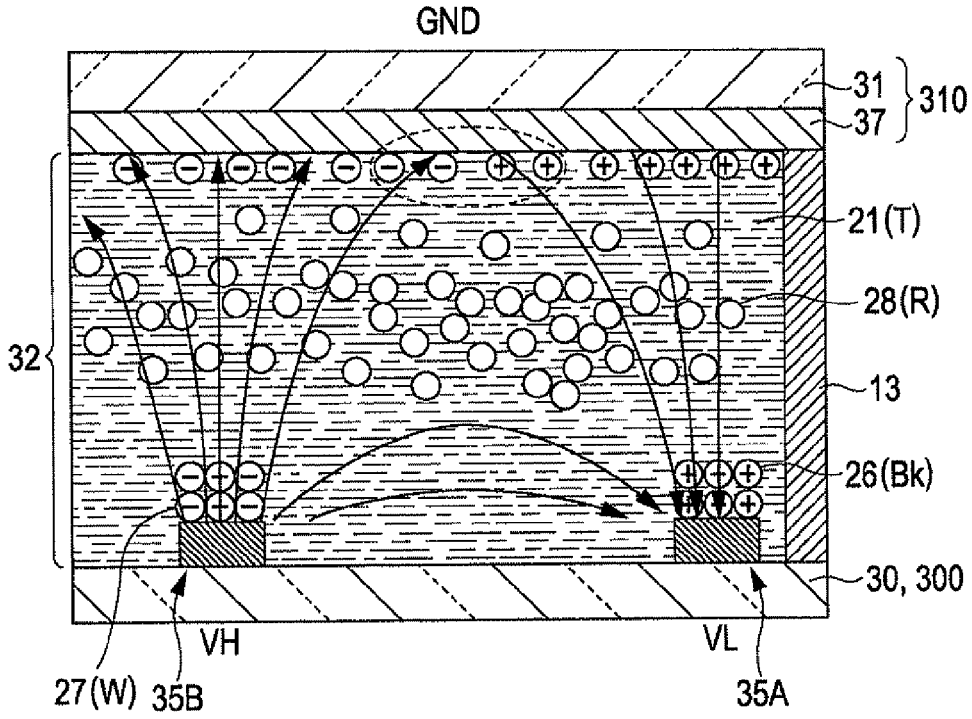
FIG. 17 is a conceptual diagram illustrating electric lines of force in the case where a distance between electrodes is made large to an excessive degree.
Figure 18:
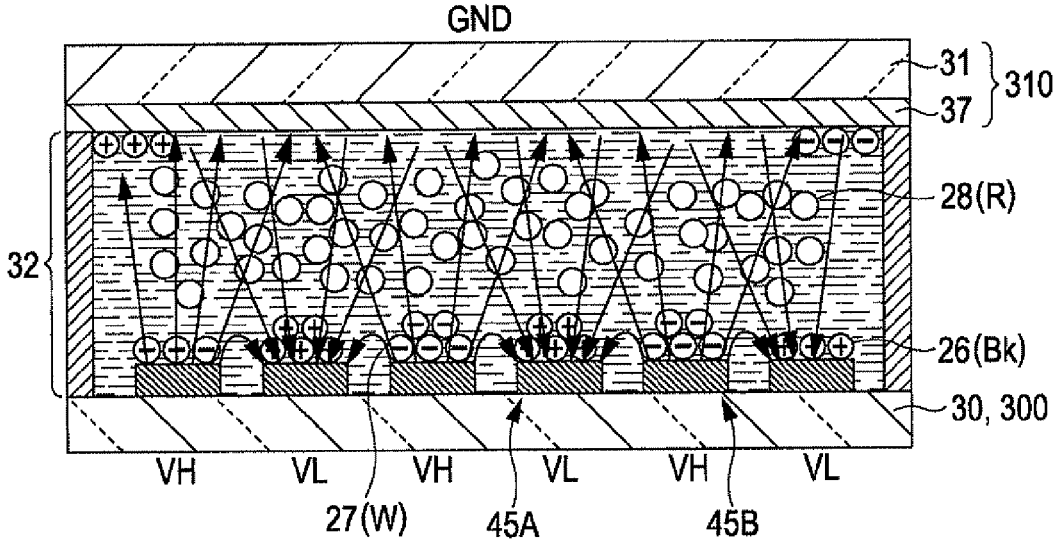
FIG. 18 is a diagram illustrating causes of display defects.
Figure 19:
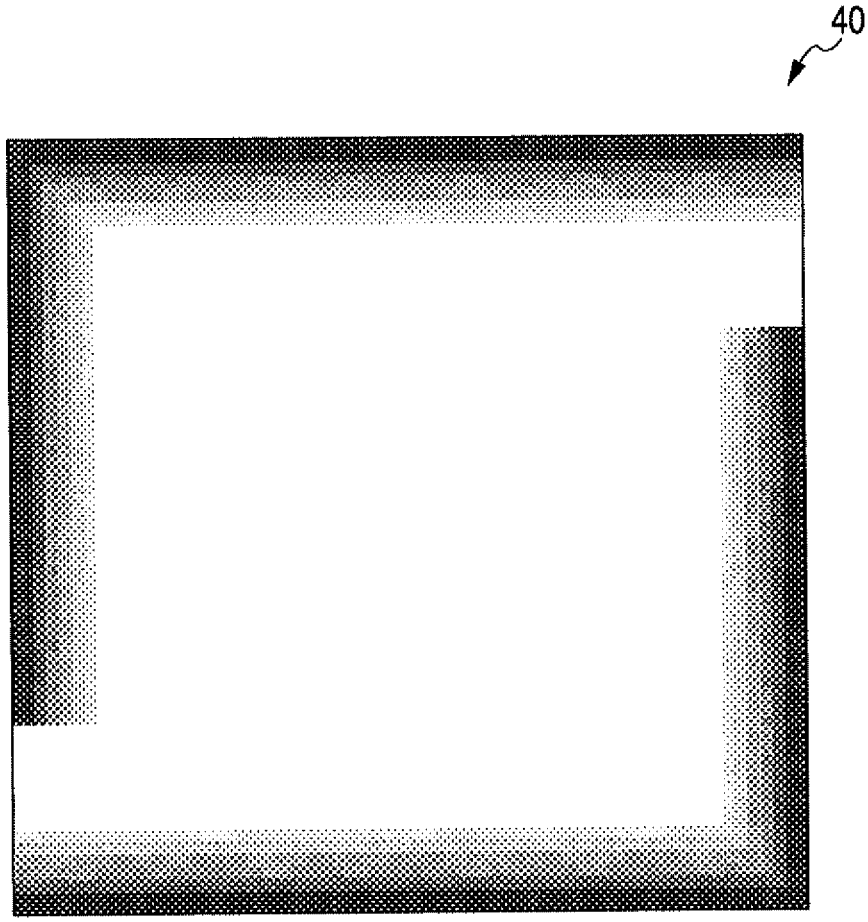
FIG. 19 is a diagram illustrating unevenness of display on a display unit.

However, if the widths of all the branch portions 38 of each of the pixel electrodes 35A and 35B are enlarged to an excessive degree, as shown in FIG. 16, longitudinally spreading electric fields do not act on central areas between the branch portions 38 and 38, and owing to this phenomenon, unintentional particles are likely to remain at the common electrode 37 side. Further, if each distance between the branch portions 38 and 38 is enlarged to an excessive degree, the same phenomenon occurs (FIG. 17). As described above, depending on a width of each of the pixel electrodes 35A and 35B and/or a distance between each pair of the pixel electrodes 35A and 35B, there occur areas that are not subjected to any actions of electric fields, and this phenomenon leads to a problem in that particles existing at the common electrode 37 side are not attracted to the pixel electrodes 35A and 35B side. This problem becomes significant at the peripheral edge portions of the pixel area. That is, as shown in FIG. 18, each of the branch portions 38 located at the peripheral edge portions of the pixel area is subjected to only electric fields arising from one of the branch portions 38 of a different pixel electrode, which is located at one side of and adjacent to the branch portion 38 located at the peripheral edge portion of the pixel area, and thus, there is increased a possibility of disabling attraction of particles existing at the peripheral edge portions. The existence of such uncontrollable particles causes unevenness of display (for example, shown in FIG. 19).

Therefore, it is necessary to provide the pixel electrodes 35A and 35B with shapes and locations allowing electric fields to favorably act on the individual particles 26 and 27. Regarding factors specifying the actions of the particles 26 and 27, there are a thickness of a cell of the electrophoretic display apparatus 100 and electrical conductivity of the dispersion medium 21, and these factors enable adjustment of spreading of the electric fields. Specifically, the shapes and locations of the pixel electrodes 35A and 35B are determined so that even areas immediately above central portions of the branch portions 38 and 38 of the respective adjacent and different pixel electrodes 35A and 35B, the branch portions 38 and 38 being at respective peripheral edge portions of the pixel area, can be subjected to electric fields.

Therefore, in this embodiment, as shown in FIG. 4, for the two groups of the plurality of branch portions 38 of the respective pixel electrode 35A and 35B, each of the first branch portions 381 (38), which are located at the respective peripheral edge portions of the pixel area, that is, at the most outer peripheral sides thereof, is formed so as to have a thickness (a width) smaller than a thickness (a width) of each of the second branch portions 382 (38), which are located at the middle portion of the pixel area. Specifically, the width of the first branch portion 381 (38), which is located at the peripheral edge portion of the pixel area, is made ⅔ of the width of the second branch portion 382 (38), which is one of the branch portions 38 other than the first branch portions 381 (38).

Figure 7:
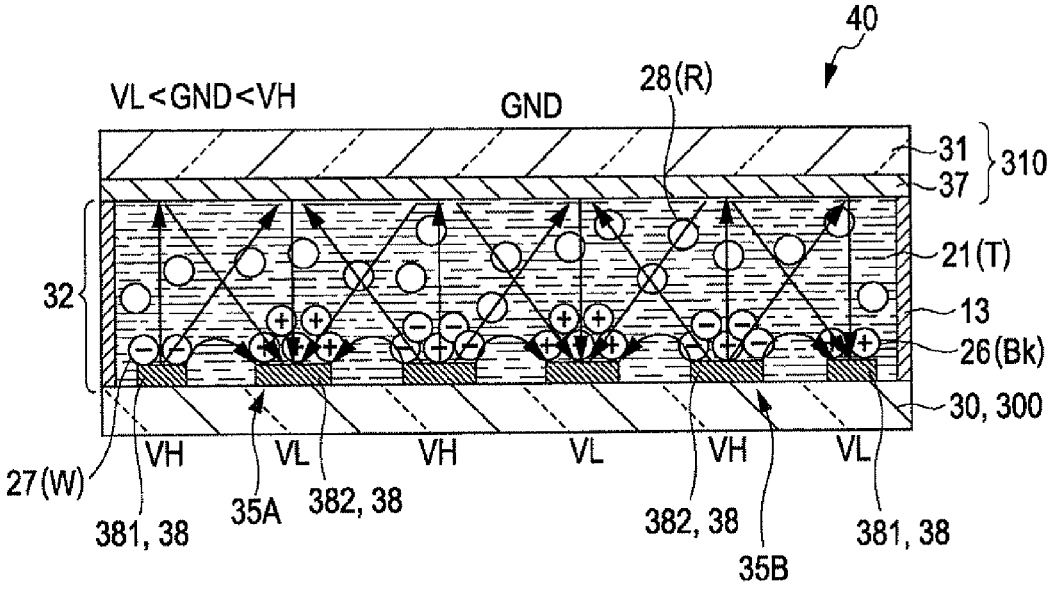
FIG. 7 is a conceptual diagram illustrating electric lines of force within a pixel of an electrophoretic display apparatus according to an embodiment of the invention.

This method enables even an area immediately above each of the branch portions 381 located at the respective peripheral edge portions of the pixel area to be subjected to electric fields arising from the branch portion 382 of an adjacent and different pixel electrode of the pixel electrodes 35A and 35B, and thus, enables causing longitudinally spreading electric fields to uniformly occur within the whole area of one pixel (FIG. 7). FIG. 7 is a conceptual diagram illustrating electric lines of force within one pixel of an electrophoretic display apparatus according to this embodiment. As shown in FIG. 7, in this embodiment, between each of the branch portions 38 and 38 of the respective pixel electrodes 35A and 35B and the common electrode 37, electric lines of force uniformly occur in a longitudinal direction (in an up-and-down direction) and in a latitude direction (in a left-and-right direction). In order to realize such a condition, a width (a line width) and an allocation distance (a space) with respect to the branch portions 38 and 38 of the respective pixel electrodes 35A and 35B can be adjusted.

Such a method as described above enables suppressing occurrence of unevenness of display by causing electric fields to act on all of the positively charged particles 26 and the negatively charged particles 27, enabling control of movements thereof, and preventing unintentional particles from remaining at the common electrode 37 side.

Accordingly, according to the configuration of this embodiment, by reducing the length of a boundary between the pixel electrodes 35A and 35B within one pixel, it is possible to reduce an amount of leakage current, and further, obtain a favorable display even at edge portions of the pixel circuit.

Further, in the configuration of this embodiment, the width-direction inner edge portion of each of the first branch portions 381 of the respective pixel electrodes 35A and 35B is aligned with a pitch that corresponds to a pitch, with which the other branch portions 38, i.e., the plurality of the branch portions 382, are aligned. In this way, as a result, for example, electric fields arising from the second branch portion 382 of the pixel electrode 35B, which is located at one side of and adjacent to the first branch portion 381 of the pixel electrode 35A, reach even an area immediately above the first branch portion 381.

In addition, in this embodiment, the width W1 of each of the branch portions 381 of the respective pixel electrodes 35A and 35B, the branch portions 381 being located at the respective peripheral edge portions of the pixel area, is made a length equal to ⅔ the width W2 of each of the branch portions 38 other than the branch portions 381, that is, the branch portions 382 (branch portions located at the middle portion of the pixel area), but may be smaller than or equal to ⅔ the width W2 thereof, and for example, the width W1 of the first branch portion 381 may be set to a length smaller than or equal to ½ the width W2 of the second branch portion 382.

Further, the width W1 of each of the branch portions 381 of the respective pixel electrodes 35A and 35B may be set to a length larger than or equal to ⅓ the width W2 of each of the second branch portions 382 if the length causes leakage current not to occur between any adjacent two branch portions 38 of the respective pixel electrodes 35A and 35B.

Further, the width of the trunk portion 36 connecting the plurality branch portions 38 with respect to each of the pixel electrodes 35A and 35B may be set to a length smaller than the width of each of the second branch portions 382. For example, setting the width of the trunk portion 36 of each of the pixel electrodes 35A and 35B to a length the same as the width of the first branch portion 381 causes electric fields to uniformly act throughout the whole pixel area.

Hereinbefore, preferable embodiments according to the invention have been described with reference to accompanying drawings, but needless to say, the invention is not limited to the embodiments. Obviously, those skilled in the art can conceive various modification examples or amendment examples within the scope of technical thoughts set forth in appended claims, but it should be noted that, naturally, they also belong to the technical scope of the invention.

For example, the partition walls 13 having been mentioned in the above-described embodiment have a function of separating the pixels 40, and a function of keeping a distance between the element substrate 300 and the opposite substrate 310. Methods for realizing this object are not limited to the partition walls 13. For example, in the case of a white-and-black color display in which it is unnecessary to perform partitioning into sub pixels, or in the case of a configuration in which a multi-color display is performed by using one pixel, a space between the substrates may be kept by using columnar spacers.

Further, a capsule-type electrophoretic material may be also used.

Further, an oxide semiconductor other than that having been described above, an amorphous silicon semiconductor, a polysilicon transistor or an organic semiconductor may be used as a semiconductor forming the selection transistor. The selection transistor may not have a bottom-gate structure but a top-gate structure.

An insulating material (for the substrate, the gate insulating film, the interlayer insulating film and the partition wall) and a wiring material are not limited to the above-described materials. For example, a different kind of an inorganic material or an organic material, such as a polyimide material, may be used as the insulating material. Moreover, a different kind of a metal material, an inorganic material, a transparent conductive material silicide, a conductive paste or the like is used as a material of a pixel electrode and the wiring material.

Further, the interlayer insulating film is formed by using a coating method, and thus, also functions as a planarization film.

Further, the pixel electrodes 35A and 35B each may have a two-layer structure of a metal material and an ITO material.

Further, although three kinds of particles having respective colors of white, black and red have been provided as electrophoretic materials in the above-described embodiment, in other sub-pixels, three kinds of particles having respective colors of white, black and blue or three kinds of particles having respective colors of white, black and green may be used. A selection method for causing the three kinds of particles to correspond to positively charged particles, negatively charged particles and non-charged particles is not limited to that in the above-described example. Moreover, a color combination for three kinds of particles may be different from the above-described color combinations. For example, a color combination of white, red and cyan, a color combination of white, green and magenta, and a color combination of white, blue and yellow may be used.

An electro-optical apparatus may be configured by not using a color system, but only a three-particle system of white, black and red. In this case, in addition to a white-and-black color display, a red-color display is enabled.

Further, it is a basis of the prevention to cause the two selection transistors to perform control of positively charged particles and negatively charged particles. Therefore, an electrophoretic material, not using the three-particle system, but combining two kinds of particles, one being positively charged ones, the other one being negatively charged ones, and a dispersion medium for keeping the two kinds of particles can be also applied. The dispersion medium may be colored, or transparent and colorless, and either of a colored medium or a transparent and colorless medium can be appropriately used depending on the purpose and configuration of the electrophoretic display apparatus.

Further, a liquid dispersion medium is used in the above-described embodiment, but the dispersion medium may be gas.

Electronics Device

Next, cases, in which an electrophoretic display apparatus according to the above-described embodiments is applied to electronics devices, will be hereinafter described.

Figure 8A:
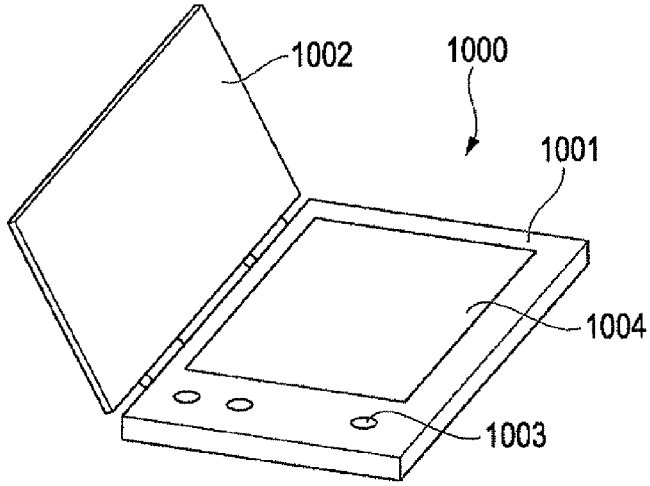
FIGS. 8A, 8B and 8C are perspective views each illustrating an example of an electronics device according to an embodiment of the invention.
Figure 8B:
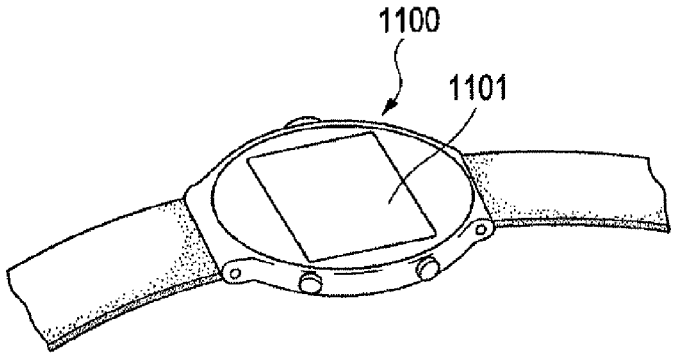
Figure 8C:
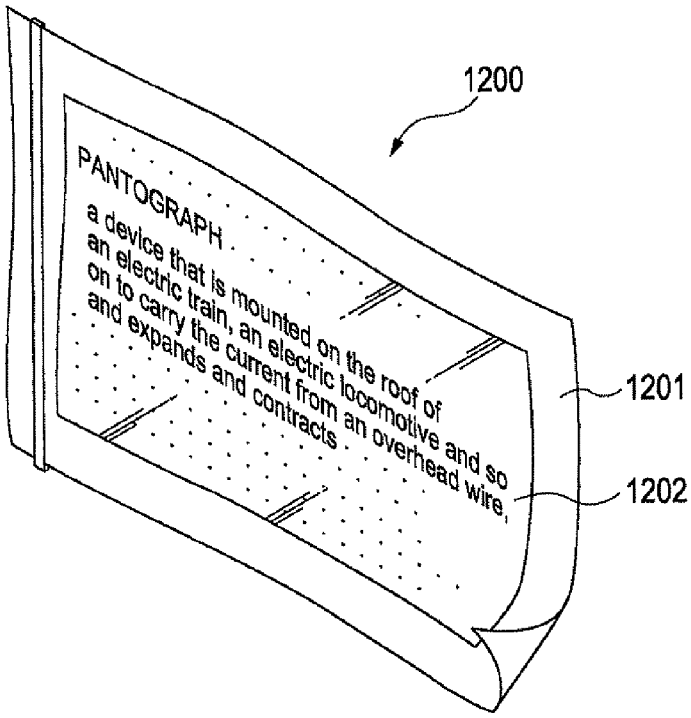

FIGS. 8A, 8B and 8C are perspective views each illustrating a specific example of an electronics device to which an electrophoretic display apparatus according to some aspects of the invention is applied.

FIG. 8A is a perspective view illustrating an electronics book, which is an example of the electronics device. This electronics book 1000 is configured to include a book-shaped frame 1001, a cover 1002, which is connected to the frame 1001 so as to be rotatable (openable and closable), an operation unit 1003, and a display unit 1004 configured by an electrophoretic display apparatus according to some aspects of the invention.

FIG. 8B is a perspective view illustrating a wristwatch, which is an example of the electronics device. This wristwatch 1100 is configured to include a display unit 1101 configured by an electrophoretic display apparatus according to some aspects of the invention.

FIG. 8C is a perspective view illustrating an electronics paper, which is an example of the electronics device. This electronics paper 1200 is configured to include a body unit 1201 configured by a rewritable sheet having a texture and flexibility just like those of a sheet of paper, and a display unit 1202 configured by an electrophoretic display apparatus according to some aspects of the invention.

For example, for the electronics book, the electronics paper and the like, since an application, in which characters are repeatedly written onto a white background, is assumed, it is necessary to eliminate an image retention after erasure, and an image retention over time.

In addition, the scope of electronics devices to which an electrophoretic display apparatus according to some aspects of the invention can be applied is not limited to these electronics devices, but widely includes apparatuses each utilizing perceivable color-tone variations in conjunction with movements of electrically charged participles.

Each of the electronics book 1000, the wristwatch 1100 and the electronics paper 1200 having been described above employs an electrophoretic display apparatus according to some aspects of the invention, and thus, is an electronics device including a color display means.

In addition, the above-described electronics devices are just examples of an electronics device according to some aspects of the invention, and do not limit the technical scope of the invention. For example, an electrophoretic display apparatus according to some aspects of the invention can be suitably used for a display unit included in an electronics device, such as a mobile telephone and a portable audio device.

The entire disclosure of Japanese Patent Application No. 2010-131896, filed Jun. 9, 2010 is expressly incorporated by reference herein.

What is claimed is:

1. An electrophoretic display apparatus comprising:

a first substrate and a second substrate;

an electrophoretic layer that is allocated between the first substrate and the second substrate, and includes particles having first color, particles having second color, and a dispersion medium;

a first electrode and a second electrode that are each formed in an island shape, for each pixel, at the electrophoretic layer side of the first substrate, and are mutually independently driven; and a common electrode that is formed at the electrophoretic layer side of the second substrate, and is larger than a total area of the first electrode and the second electrode, wherein the first electrode forms a comb-teeth shape electrode in plan view including a plurality of first branch portions and a first trunk portion that connects the plurality of first branch portions, the plurality of first branch portions including a first edge branch portion that is located at a first edge portion of a pixel area and has a width smaller than a width of each of the remaining first branch portions;

the second electrode forms a comb-teeth shape electrode in plan view including plurality of second branch portions and a second trunk portion that connects the plurality of second branch portions, the plurality of second branch portions including a second edge branch portion that is located at a second edge portion of the pixel area and has a width smaller than a width of each of the remaining second branch portions; and the plurality of first branch portions and the plurality of second branch portions are aligned in one direction.

2. The electrophoretic display apparatus according to claim 1, wherein the width of the first edge branch portion is smaller than or equal to ⅔ the width of each of the remaining first branch portions.

3. The electrophoretic display apparatus according to claim 1, wherein the width of the first edge branch portion is smaller than or equal to ½ the width of each of the remaining first branch portions.

4. The electrophoretic display apparatus according to claim 1, wherein the width of the first edge branch portion is larger than or equal to ⅓ the width of each of the remaining first branch portions.

5. The electrophoretic display apparatus according to claim 1, wherein a width-direction inner edge portion of the first edge branch portion is aligned with a pitch that corresponds to a pitch with which the remaining first branch portions are aligned.

6. An electronics device comprising the electrophoretic display apparatus according to claim 1.

7. An electronics device comprising the electrophoretic display apparatus according to claim 2.

8. An electronics device comprising the electrophoretic display apparatus according to claim 3.

9. An electronics device comprising the electrophoretic display apparatus according to claim 4.

10. An electronics device comprising the electrophoretic display apparatus according to claim 5.

* * * * *